United States Patent [19]

Koufos

[11] 4,353,537

[45] Oct. 12, 1982

[54] SECURING AND CLAMPING DEVICE

[76] Inventor: James Koufos, 22188 Harrisburg Westville Rd., Alliance, Ohio 44601

[21] Appl. No.: 248,875

[22] Filed: Mar. 30, 1981

[51] Int. Cl.[3] ..... B25B 1/24

[52] U.S. Cl. ..... 269/266; 269/275; 269/283; 269/289 MR; 29/148.4 C; 192/107 C

[58] Field of Search ..... 269/289 MR, 266, 268–270, 269/275, 283, 285, 273–275; 29/198.4 C; 192/107 C

[56] References Cited

U.S. PATENT DOCUMENTS

| | | | |
|---|---|---|---|
| 1,256,217 | 2/1918 | Fieldhouse | 269/266 |
| 2,288,158 | 6/1942 | Ellinwood | 269/275 |
| 3,588,207 | 6/1971 | Greby | 29/148.4 C |
| 3,604,700 | 9/1971 | Gault | 269/266 |
| 4,047,709 | 9/1977 | Thyberg et al. | 269/266 |

*Primary Examiner*—Robert C. Watson

*Attorney, Agent, or Firm*—Oldham, Oldham, Hudak & Weber Co.

[57] ABSTRACT

A device for clamping or forceful engagement. Top and bottom casing members are maintained in restricted movable engagement with each other. Received within the casing members are a plurality of balls, arranged in layers. Certain of the balls are spring-biased to urge the top and bottom casing members away from each other. In one embodiment of the invention, certain of the balls protrude through the top casing member and adapt to clamp objects of varying geometrical configurations. As forceful engagement is attained, the balls of the device compress and interlock with each other. In another embodiment of the invention, the top casing is without holes and the apparatus may then be used to achieve forceful engagement with an angled surface such as in a clutch mechanism.

10 Claims, 5 Drawing Figures

SECURING AND CLAMPING DEVICE

TECHNICAL FIELD

The invention herein lies in the art of securing devices. More particularly, the invention relates to a securing device for utilization in a vice which is adapted to accommodate any of numerous geometric configurations. In the same manner by which different geometric configurations can be secured, the apparatus is also adapted for use in a clutch mechanism to assure even, forceful engagement between the wear plate and friction disk of a clutch assembly.

BACKGROUND ART

Heretofore in the art, numerous types of clamping and securing devices have been known. The general public is well aware of the use of vices for securing and maintaining a workpiece when an operation is to be performed thereon. However, such known vices and clamps are peculiarly adapted for one specific geometric structure. The jaws of known vices are typically flat, for securing planar surfaces. While some devices do include arcuate jaws for securing pipe and other objects of circular cross-section, even these vices are not adapted for receiving and maintaining objects of a complex geometric nature.

If a curvate workpiece is secured in a device having planar jaws, only point contact of the workpiece is achieved, and the secured engagement is generally less than that desired. Similarly, if a flat workpiece is to be secured by a clamp or device having curvate jaws, only point contact will again be obtained. There are no known devices which may be used for obtaining secured forceful engagement with a piece while conforming to the geometric structure of that piece.

In present day clutch systems, the inflexibility of the system itself, failing to allow the wear plate and friction disk to fully mate with each other, results in high points being left on the wear disk, uneven wear being experienced by the system, and reduced effectiveness and life of the clutch assembly. Since the wear plate may not achieve adjustable engagement with the clutch disk, only the high points of the wear plate make secured contact. Again, in the art of clutch assemblies, there is not provided a suitable means for adjustably achieving secured forceful engagement between the wear plate and friction disk.

In general, there is a need in the art for a device which can make contact with different geometric surfaces, conform to the geometries thereof, and do so in a forceful and securing manner.

There are teachings in the prior art pertaining to apparatus which is adaptable to conform to various geometric structures. While the prior art has made general suggestions of such adjustability, the art has failed to achieve a securing or clamping device for achieving forceful engagement of workpieces of complex geometric structure. The known prior art is illustrated generally in U.S. Pat. Nos. 1,153,727; 1,256,217; 2,486,494; 626,427; 3,318,594; 2,411,790; 4,047,709; 4,088,312; 4,027,868; 3,868,102; and 3,584,863. Additionally, British Pat. No. 1,227,530, and Austrian Pat. No. 101,174, are of general interest to the concept of the invention presented herein.

DISCLOSURE OF THE INVENTION

In light of the foregoing, it is an object of the instant invention to provide a clamping apparatus which is adaptable to conform to numerous geometric configurations.

It is another object of the invention to provide a clamping device which is biased to a predetermined configuration, and which seeks to obtain such configuration when released from clamping engagement.

An additional object of the invention is to provide a securing and clamping device which may be angled to make securing forceful engagement with a planar surface which is oblique to the device as a whole.

Still an additional object of the invention is to provide a securing and clamping device which is reliable and durable in operation, while being easily and inexpensively constructed using readily available components.

The foregoing and other objects of the invention which will become apparent as the detailed description proceeds are achieved by a clamping device comprising: a hollow casing having top and bottom portions; and a plurality of balls maintained within said casing in restricted movable engagement with each other.

BRIEF DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 1:
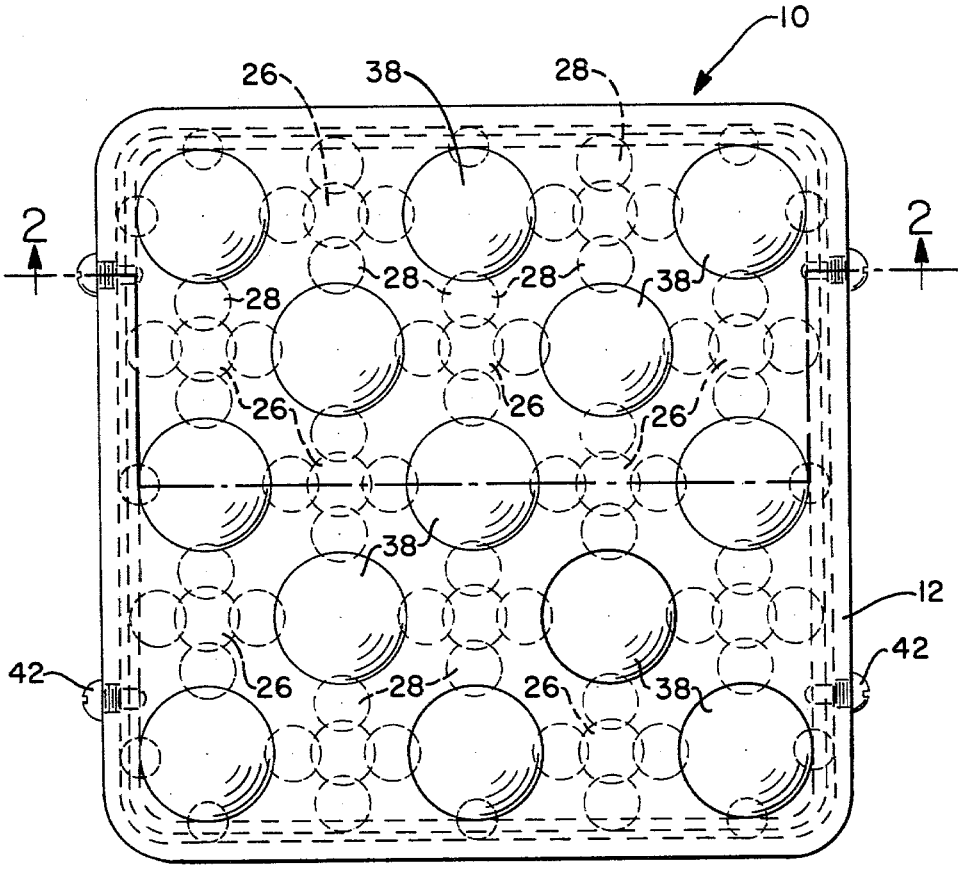
FIG. 1 is a top plan view of the clamping device of the invention showing certain of the locking balls thereof in phantom.
Figure 2:
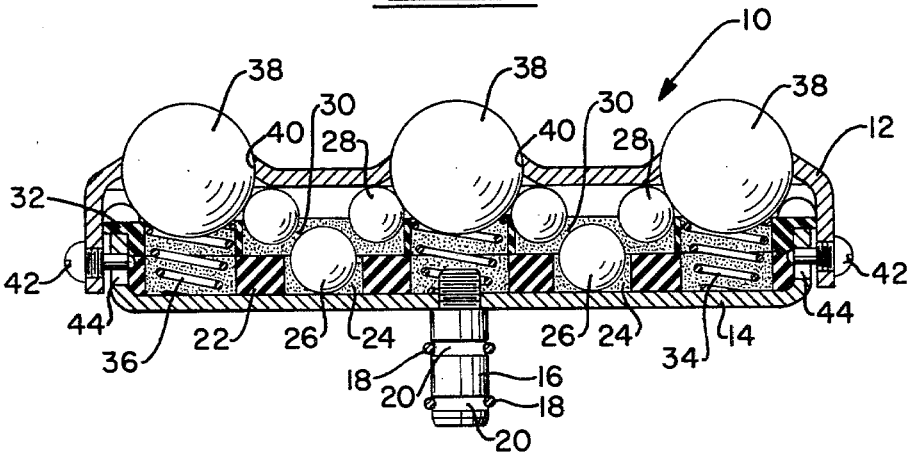
FIG. 2 is a side sectional view of the device of FIG. 1 showing the layers of locking balls thereof.

Referring now to the drawings and more particularly FIGS. 1 and 2, it can be seen that a clamping device made according to the invention is designated generally by the numeral 10. The device includes top and bottom casings 12,14, with the bottom casing 14 being characterized by an arbor 16 preferably extending centrally therefrom. As illustrated, the arbor 16 may be threadedly secured to the casing 14, but it will be understood that such engagement could also be by welding or the like. The arbor 16 is characterized by a pair of locking compression rings 18 received in circumferential grooves 20 passing thereabout. As will be discussed hereinafter, the compression ring 18 of the arbor 16 allow for snap-fitting engagement with a hole or bore provided, for example, in the jaws of a vice.

As best shown in FIG. 2, the bottom casing 14 receives a base rubber sheet or mat 22. While it is not necessary that this mat be of rubber construction, it is preferred that it be of a resilient material. In any event, the mat 22 is characterized by a plurality of circular openings 24 passing therethrough, such openings receiving a lower series of balls 26, as shown. It will be understood that the openings 24 are of a diameter just slightly greater than the diameter of the balls 26 received therein.

A series of intermediate balls 28, of preferred diameter less than that of the balls 26, are received in openings 30 provided in a second resilient mat 32. The openings 30 are shaped like a fourlead clover to receive the cluster of four intermediate balls 28 about the associated lower balls 26.

The mats 22,32 are characterized by openings 34 in common registration with each other. These openings 34 receive therein conical compression springs 36 which are interposed between the bottom casing 14 and an upper series of balls 38. The compression springs 36 urge the balls 38 into protrusion from the flared, conical openings 40 in the top casing 12.

As best illustrated in FIG. 2, the top casing 12 is movably secured to the bottom casing 14 by means of pin screws 42. These pin screws 42 are threadedly engaged with the top casing 12, with the pin portion thereof being received in slots 44 in the bottom casing 14. Accordingly, relative movement between the casings 12,14 is possible.

It will now be appreciated that in its quiescent, unbiased condition, the largest upper series of balls 38 are urged by associated compression springs 36 through the conically flared openings 40 in the top casing 12. There is then maximum separation between the top and bottom casings 12,14. Accordingly, the intermediate series of balls 28 are loosely maintained within the four-leaf clover shaped openings 30 as are the lower series of balls 26 in their respective openings 24.

Figure 3:
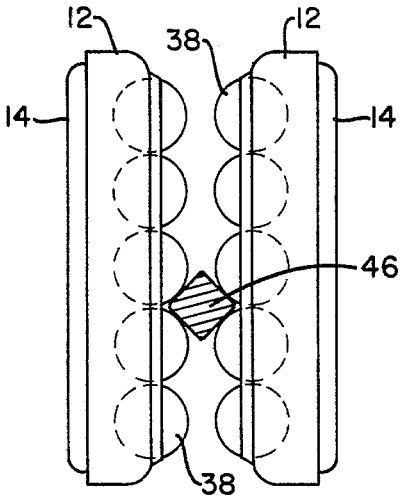
FIG. 3 is a side elevational view of the invention showing the same securing a piece of rectangular cross-section.
Figure 4:
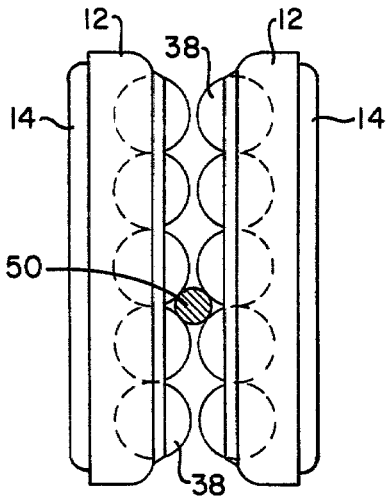
FIG. 4 is a side elevational view of the invention showing the same securing a piece of circular cross-section.

In use, a pair of devices 10 are typically used for securing a workpiece as shown in FIGS. 3 and 4. A vice may be provided with the jaws thereof each having a bore of substantially the same diameter as the arbor 16. A pair of clamping devices 10 may then be affixed to the vice jaws by insertion of the arbor 16 into the bore, the locking compression rings 18 achieving secured engagement.

With the devices 10 maintained by the vice jaws, a workpiece may be interposed between the pair of devices 10 and the jaw vices closed in standard fashion. The workpiece moves against the large upper series of balls 38 and nestles into secured tangential contacting engagement with the balls 38 dependent upon the geometric configuration of the workpiece itself. The balls 38 which are contacted by the workpiece compress against the associated compression spring 36 such that the balls 38 come into forceful contacting engagement with the intermediate series of balls 28. These balls 28 are urged against the lower series of balls 26 which are maintained by the bottom casing 14. Such movement is achieved not only due to the relative mobility of the balls 26,28,38, but also because of the relative mobility of the top and bottom casings 12,14 via the pin and slot interconnection at 42,44.

It will be apparent that lateral movement of the various balls 26,28,38 is restricted. Movement of the balls 38 is restricted by the conical openings 40, and movement of the balls 28,26 is restricted by locking interengagement of the various layers of balls with each other as well as by the resilient mats 22,32. However, the axial movement of the various balls which may be achieved allows for the balls 38 to make contacting engagement with work-pieces of any of numerous geometric configurations. The axial movement of each of the balls is somewhat independent of all other balls, being urged by the workpiece and bottom casing 14 until locking engagement is achieved.

While the invention thus far has been discussed in terms of use of the devices 10 in pairs, it should be understood that such need not be the case. It has been found that a single device 10 may be used to make securing engagement with a workpiece against a planar surface such as a vice jaw.

As shown in FIG. 3, a rectangular workpiece 46 may be locked between the balls 38 with four-point tangential engagement being achieved. It will also be appreciated that the workpiece 46 is engaged on all four sides thereof, rather than only two sides in a standard vice arrangement.

Similarly, in FIG. 4, a workpiece of circular cross-section is illustrated as being locked on four tangential points. The workpiece 50 could, indeed, be a tapered round shaft, such as a golf club shaft, and still receive locking engagement along the entire width of the devices 10.

It should now be appreciated by those skilled in the art, and particularly from the illustrative showings of FIGS. 3 and 4, that the clamping devices 10 are adapted for securing workpieces of any of numerous geometric configurations.

Figure 5:
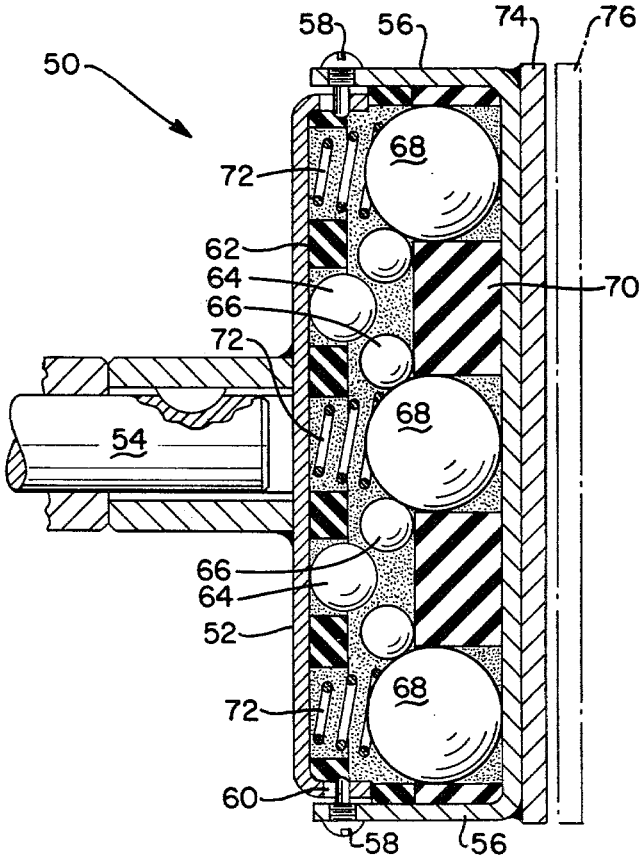
FIG. 5 is an illustrative showing of the invention utilized as a clutch plate.

The concept of the invention of a device having a surface which may be angled with respect to the central axis thereof is particularly adapted for devices such as the clutch mechanism 50 of FIG. 5. Here, a base plate 52 is received by a shaft 54 as by a collar or the like. The top plate 56, this time without openings therein, is secured to the base plate 52 as by the screw pin-slot engagement 58,60. A single base mat 62 is here provided for receiving a lower series of balls 64 in appropriate openings. An intermediate series of balls 66 is provided in common contacting engagement with the lower balls 64 and an upper series of balls 68. The upper balls 68 are separated and maintained by holes within an upper mat 70 as illustrated, the mat 70 making typical contacting engagement with the intermediate series of balls 66. Again, conical compression springs 72 are provided for urging or biasing the balls 68 away from the base 52.

Affixed to the top plate 56 is a wear plate 74 which, in standard fashion, is adapted for making frictional contacting engagement with the friction disk 76 to drive the shaft 54. As is well known to those skilled in the art, misalignment between the wear plate 74 and friction disk 76 can result in high points developing therebetween, reducing the efficiency of the clutch assembly and often resulting in a chattering or slipping of the clutch. The assembly 50 allows the wear plate 74 to adapt to aligned contacting engagement with the friction disk 76 to eliminate the possible creation of such high points. It will be appreciated that as the plate and disk 74,76 come into contacting engagement, they will seek to do so in a continuously flush manner, the balls 64–68 adjusting against each other to allow the plate 56 to angle to achieve and maintain such flush engagement. When the clutch is released, the biasing of the compression springs 72 urges the plate 56 and balls 64–68 into their quiescent position for the next subsequent clutch engagement.

Thus it can be seen that the objects of the invention have been satisfied by the structure presented hereinabove. The concept of the invention is applicable to both a clamping device and a clutch mechanism, as well as to other apparatus in which adjustable locking is desired. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be had to the appended claims.

What is claimed is:

1. A clamping device, comprising:

a hollow casing having top and bottom portions;

a plurality of balls maintained within said casing in restricted movable engagement with each other, said balls being maintained within said casing in layers, a first layer in contact with said top portion and a second layer in contact with said bottom portion, and an intermediate layer therebetween; and means associated with the balls of each of said layers for restricting lateral movement of said balls within their respective layers, said means comprising first and second mats having holes therein for respectively receiving said second and intermediate layers of balls.

2. The clamping device according to claim 1 wherein said first layer of balls is biased away from said bottom portion.

3. The clamping device according to claim 1 wherein said means for restricting lateral movement further includes a plurality of projected openings in said top portion, each receiving one of said balls of said first layer.

4. The clamping device according to claim 3 wherein said mats have aligned openings receiving biasing springs therein, said springs being interposed between said bottom portion and said balls of said first layer.

5. The clamping device according to claim 1 wherein said top and bottom portions of said casing are interconnected by means for allowing restricted relative movement therebetween.

6. The clamping device according to claim 5 wherein said bottom portion of said casing has an arbor centrally extending therefrom.

7. A device, comprising:

top and bottom casings in restricted movable engagement with each other;

a plurality of balls maintained between said casings in movable and locking engagement with each other; and a resilient mat receiving certain of said balls.

8. The device according to claim 7 wherein said balls are of varying sizes and are maintained in layers within said casings.

9. The device according to claim 8 which further includes spring means in biasing contacting engagement with certain of said balls.

10. The device according to claim 9 wherein said top casing is characterized by a plurality of truncated conical springs receiving certain of said balls.

* * * * *